US007946421B2

(12) United States Patent
Kowalik et al.

(10) Patent No.: US 7,946,421 B2
(45) Date of Patent: May 24, 2011

(54) SERIALLY CONNECTED PACKETS WITH END INDICATOR

(75) Inventors: Francis C. Kowalik, Deerfield, IL (US); Christina M. Palazzolo, Chicago, IL (US)

(73) Assignee: Walgreen Co., Deerfield, IL (US)

( * ) Notice: Subject to any disclaimer, the term of this patent is extended or adjusted under 35 U.S.C. 154(b) by 678 days.

(21) Appl. No.: 11/741,542

(22) Filed: Apr. 27, 2007

(65) Prior Publication Data

US 2008/0264966 A1 Oct. 30, 2008

(51) Int. Cl.
*B65D 83/04* (2006.01)

(52) U.S. Cl. ..... 206/534; 206/459.5

(58) Field of Classification Search ..... 206/534, 206/534.1, 528, 459.5, 529, 532, 536, 538
See application file for complete search history.

(56) References Cited

U.S. PATENT DOCUMENTS 3,385,421 A 5/1968 Huck
3,432,951 A * 3/1969 Cherrin ..... 40/107
3,773,250 A 11/1973 Phillips
3,931,885 A 1/1976 Nahill et al.
4,223,801 A * 9/1980 Carlson ..... 221/3
4,419,016 A * 12/1983 Zoltan ..... 368/10
4,972,657 A * 11/1990 McKee ..... 53/411
5,839,257 A 11/1998 Soderstrom et al.
6,170,230 B1 1/2001 Chudy et al.
6,202,385 B1 3/2001 Kim
6,256,967 B1 7/2001 Hebron et al.
6,263,639 B1 7/2001 Kim
6,370,841 B1 4/2002 Chudy et al.
6,449,927 B2 9/2002 Hebron et al.
6,508,279 B2 1/2003 Siegel et al.
6,601,729 B1 8/2003 Papp
6,625,952 B1 9/2003 Chudy et al.
6,742,671 B2 6/2004 Hebron et al.
6,769,228 B1 8/2004 Mahar
6,898,919 B2 5/2005 Kim
6,902,083 B1 6/2005 Michael et al.
6,963,791 B1 11/2005 Frederick et al.
6,970,769 B2 11/2005 Rice et al.
6,983,579 B2 1/2006 Rice et al.
7,010,899 B2 3/2006 McErlean et al.
7,017,513 B2 * 3/2006 Giewercer ..... 116/308
7,048,142 B1 5/2006 Michael et al.
7,059,098 B2 6/2006 Kim
2001/0027634 A1 10/2001 Hebron et al.
2002/0117405 A1 * 8/2002 Wang et al. ..... 206/5.1
2003/0056467 A1 3/2003 Kim
2003/0057225 A1 3/2003 Kim
2003/0070394 A1 4/2003 Rosenbaum
2003/0156925 A1 8/2003 Kim
2004/0031719 A1 * 2/2004 Weinstein ..... 206/534
2004/0123565 A1 7/2004 Rice et al.
2004/0176873 A1 9/2004 Kim
2004/0260424 A1 12/2004 Mahar (Continued)

*Primary Examiner* — Jacob K Ackun, Jr.
(74) *Attorney, Agent, or Firm* — Francis C. Kowalik; Marshall, Gerstein & Borun LLP

(57) ABSTRACT

A strip containing a prescription of individual dosages of medicine includes a plurality of packets connected in a series. The plurality of packets includes at least one filled packet that includes a plurality of medications. The strip has a first end, a second end, and an ending group. The ending group includes a subset of the plurality of packets and is adjacent the second end. An indicator is associated with the ending group, wherein the indicator can inform a user that the ending group is adjacent the second end of the strip.

4 Claims, 5 Drawing Sheets

U.S. PATENT DOCUMENTS

2005/0274728 A1 12/2005 Kim
2006/0061467 A1 3/2006 Kim
2006/0065670 A1* 3/2006 Doublet et al. ..... 221/1
2006/0074521 A1 4/2006 Rice et al.
2006/0090422 A1 5/2006 McErlean et al.
2006/0107623 A1 5/2006 Rice et al.
2006/0118386 A1 6/2006 Kim
2006/0122729 A1 6/2006 Murphy et al.
2006/0167719 A1 7/2006 Kim
2009/0078606 A1* 3/2009 Conley et al. ..... 206/534

* cited by examiner

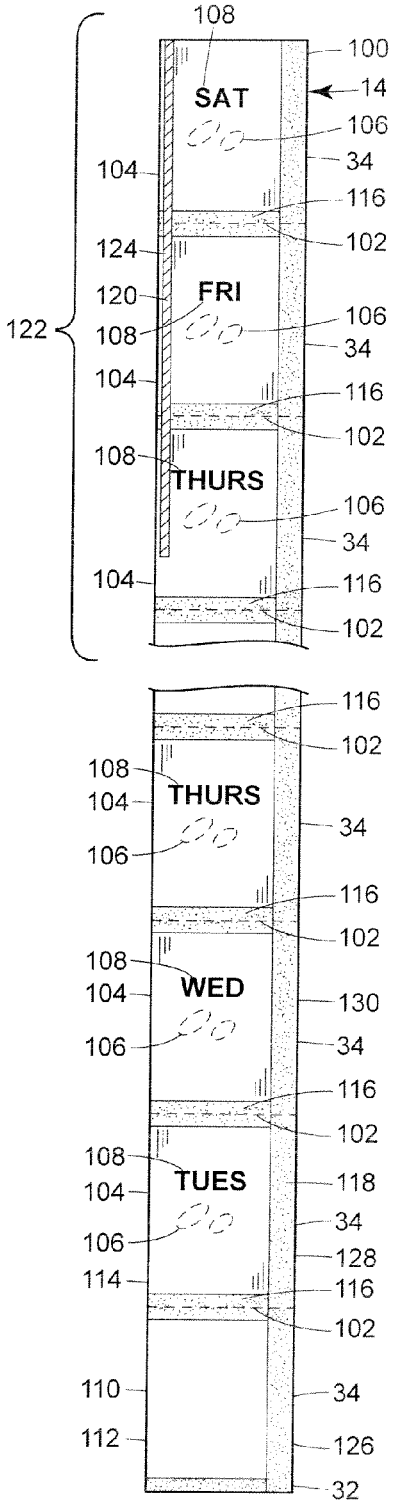
FIG. 5
FIG. 6
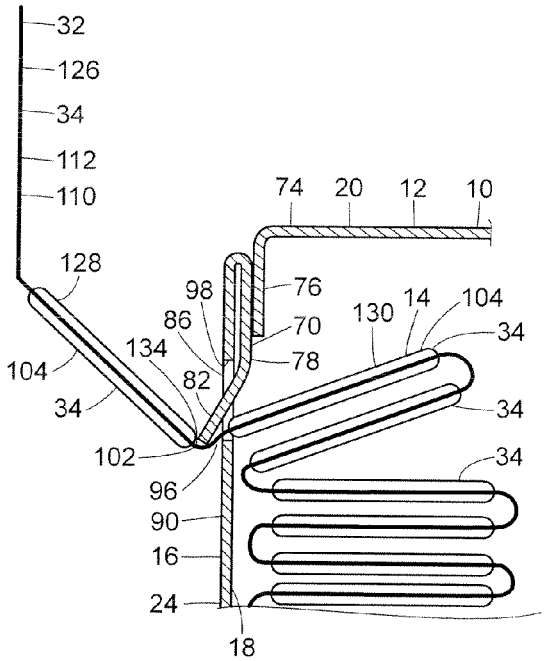

SERIALLY CONNECTED PACKETS WITH END INDICATOR

FIELD OF THE INVENTION

The following disclosure relates to a set of serially connected packets that can be used to store, for example, doses of medicine, and more particularly, to a set of serially connected packets that includes an indicator at one end.

BACKGROUND OF THE INVENTION

It is well known that people purchase medications prescribed by doctors to address illnesses or unhealthy conditions. Each prescription generally is delivered to the user in a vial with instructions regarding, for example, the name of the medication and the frequency in which the medication is to be ingested. In a case where a user is taking one or two medications, he or she can generally remember to take the medications at the correct times.

However, certain users require several medications, each to be taken at varying intervals. This leaves the user to his or her own devices to sort through many vials, remembering which medication is to be taken at which time. This system, while simple, can be confusing. The user is at risk of mistakenly taking too much or too little of a prescribed medication, which can be dangerous. Further, some households have multiple people taking medications. While certain entities have placed color coded-rings about the necks of these vials, there is no easily identifiable way to discern which of the vials are for which family member.

To address this issue, medication cases have been developed with individual compartments that are each labeled for a particular day of the week. The user can then sort the pills into each of the compartments according to which pills need to be taken on which days. If the user is correct in his or her sorting, this system is effective to indicate to the user whether or not he or she has taken the required medication for the day. However, this system also depends on the user to correctly sort each of the medications into the correct individual compartments. Further, pills can spill from one compartment to the next.

Recently, a system has been developed by Prairie Stone Pharmacy in which a user's medications are delivered in individual packets connected together by perforated connections to form a strip. All of the medications that a user requires for a day (or another particular time period) is stored in a single packet. The user's medications for the next day are stored in the adjacent packet. Each packet includes indicia that instruct the user at which time to take the medication. For example, a first packet indicates Monday, the second packet indicates Tuesday, etc. Further, the strip is stored in a container, where the container has an opening, and the strip may be pulled out of the container through the opening. The user can tear off individual packets, while the remaining packets stay in the container.

Several problems still exist with this most recent system. First, the system provides no structure to aid the user in grasping the first packet filled with medication. In other words, when this system is delivered, the entire strip must disposed within the container to protect the medication, and the user is required to open the container and feed the strip through the opening him or herself. Next, the opening of the container has no structure to pinch or otherwise maintain the strip or aid in tearing a first packet from a second packet. Because the container does not grasp the strip, after a packet is torn away from the strip, the strip is not adequately held within the opening of the container. Finally, the system provides no indication that a user is running low on medication. Thus, without looking inside container, the user has no idea if he or she must refill the prescription.

BRIEF DESCRIPTION OF THE DRAWINGS

FIG. 5 is a plan view of a strip of medicine packets.

FIG. 6 is a cross sectional view of the medicine dispensing assembly, taken along line 6-6 in FIG. 1.

DETAILED DISCLOSURE

Figure 1:
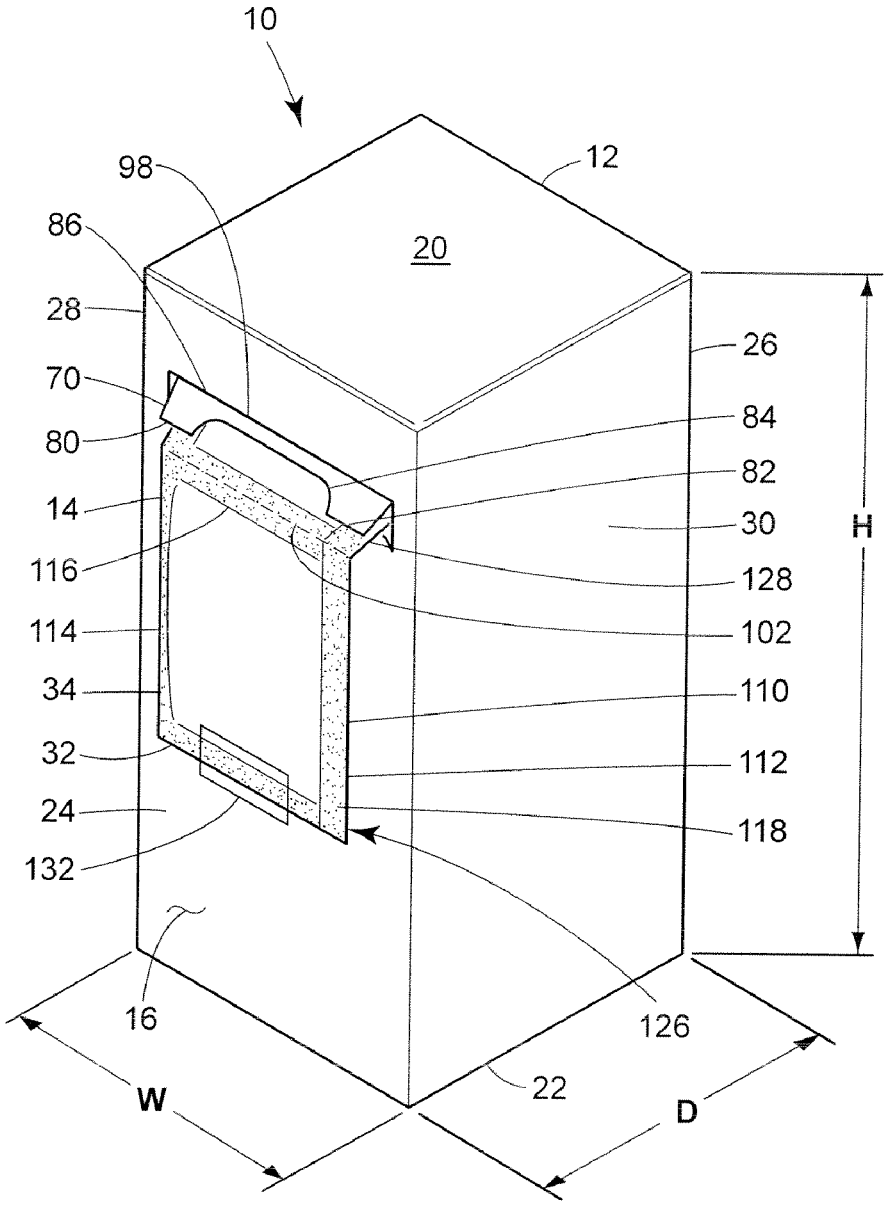
FIG. 1 is a perspective view of a medicine dispensing assembly.

Referring now to FIG. 1, an assembly 10 for dispensing medication is shown. The assembly includes a container 12 and a medication strip 14 ("the strip"). The container 12 is a parallelepiped shaped with an exterior surface 16 and an interior surface 18 (best seen in FIG. 3). The container 12 has a top side 20, a bottom side 22, a front side 24, a back side 26, a left side 28, and a right side 30. The container further has a height H, width W, and depth D. In this example, the height H is longer than the width W and the depth D, such that the container 12 is relatively tall and narrow. A majority of the strip 14 is disposed within the container 12, and a first end 32 of the strip 14 extends out of the container 12 such that the first end 32 is accessible by a user. As will be described more completely herein, the strip 14 includes a plurality of discrete packets 34 that can contain dosages of medication in the form of, e.g., pills.

Figure 2:
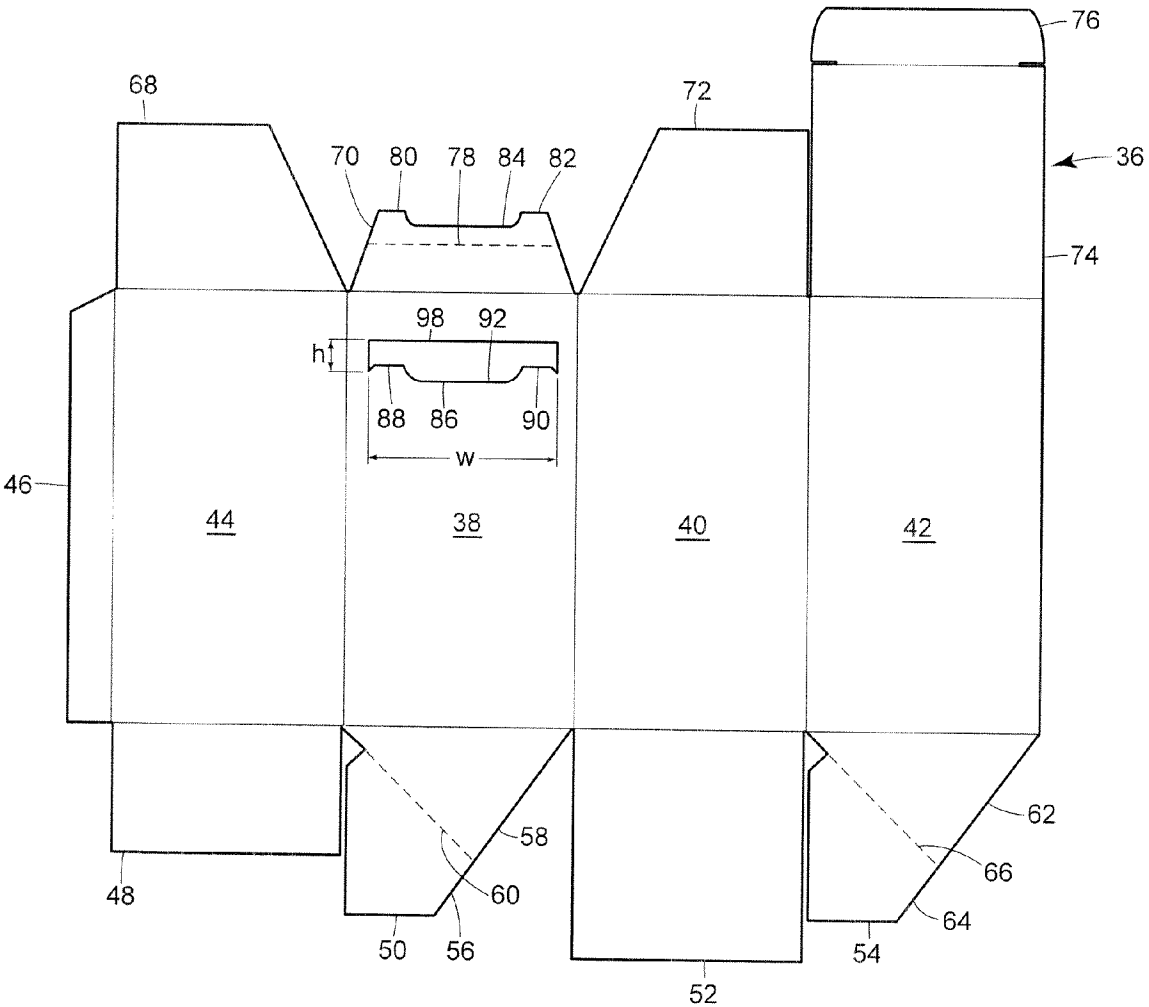
FIG. 2 is a plan view of a blank used to construct the container of the medicine dispensing assembly of FIG. 1.

Referring now to FIG. 2, a blank 36 is depicted that can be used to form the container 12. The blank 36 in this example is made from paper board, but it may be constructed from other materials such as corrugated paper or sheet plastic. The blank includes a front panel 38, a right panel 40 foldably connected to the front panel 38, a back panel 42 foldably connected to the right panel 40, and a left panel 44 foldably connected to the front panel 38. A connector tab 46 is foldably connected to the left panel 44.

The blank 36 includes a left bottom tab 48 foldably connected to the left panel 44, a front bottom tab 50 foldably connected to the front panel 38, a right bottom tab 52 foldably connected to the right panel 40, and a back bottom tab 54 foldably connected to the back panel 42. The front bottom tab 50 includes a first bottom triangular portion 56 and a first bottom connector tab 58 separated by a perforation 60, and the back bottom tab 54 includes a second bottom triangular portion 62 and a second bottom connector tab 64 also separated by a perforation 66.

The blank 36 further includes a left top tab 68 foldably connected to the left panel 44, a locking flap 70 foldably connected to the front panel 38, a right top tab 72 foldably connected to the right panel 40, and a back top tab 74 foldably connected to the back panel 42. Further, a back flap 76 is foldably connected to the back top tab 74. The locking flap 70 can include a line of weakness 78 such as a perforation or a score to help in bending the locking flap 70, as will be detailed herein. The locking flap 70 can include a first locking tab 80 and a second locking tab 82 each extending upwardly (as shown in FIG. 2) and separated by a first recess 84.

Finally, the front panel 38 of the container 12 includes an opening 86. The opening 86 has a height h this is comparatively small relative to its width w. The front panel 38 includes a third locking tab 88 and a fourth locking tab 90 each extending upwardly into the opening 86. The third locking tab 88 and the fourth locking tab 90 are separated from each other by a second recess 92.

To construct the container 12, each of the front panel 38, the right panel 40, the left panel 44, the back panel 42, and the connector tab 46 are folded at a right angle to each of their respective adjacent panels, and the connector tab 46 is bonded or otherwise connected to the back panel 42 such that a tubular structure is formed.

To form the bottom side 22, the right bottom tab 52 is folded up and perpendicular to the right panel 40. The second bottom connector portion 64 is folded 180° about the perforation 66 such that it lies on top of the second bottom triangular portion 62. The back bottom tab 54 is then folded upwardly, and the second bottom connector portion 62 is then bonded or otherwise connected to the right bottom tab 52. Likewise, left bottom tab 48 is folded 90° relative to the left panel 44. The first bottom connector portion 56 is folded 180° about the perforation 60 such that it lies on top of the first bottom triangular portion 58. The front bottom tab 50 is then folded upwardly, and the first bottom connector portion 56 is bonded to the left bottom tab 48.

Figure 3:
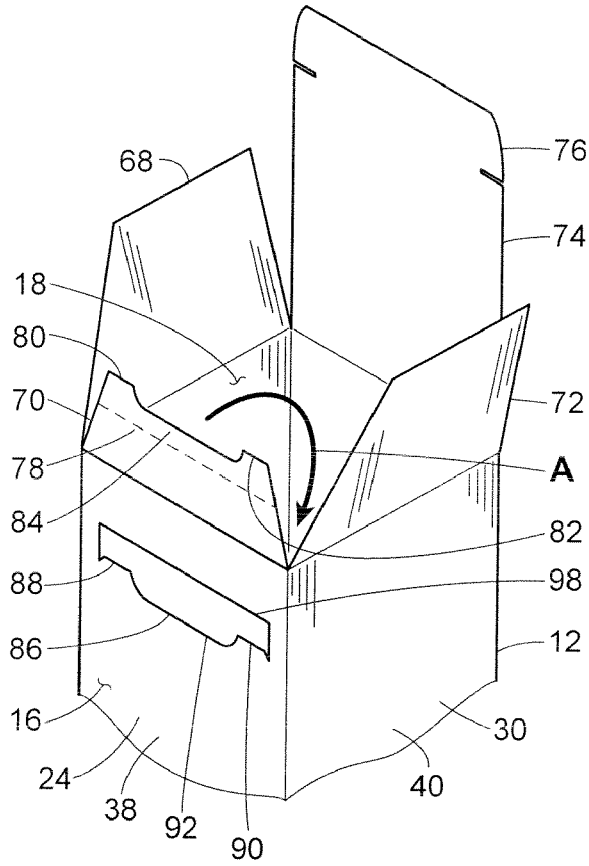
FIG. 3 is a perspective view of a portion of the container of FIG. 1 in a partially constructed format.
Figure 4:
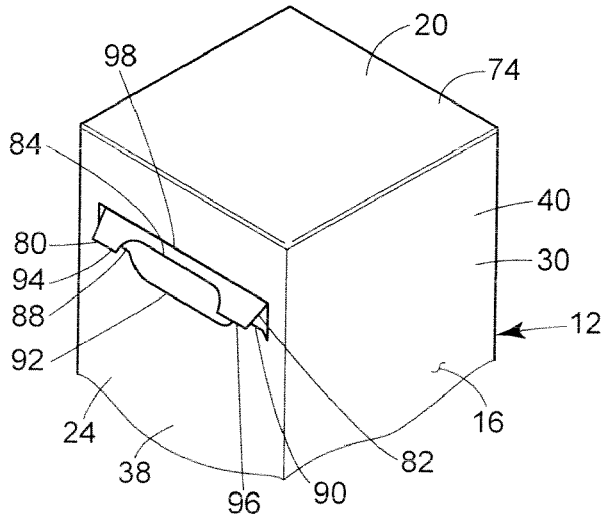
FIG. 4 is a perspective view of a portion of the container of FIG. 1 is a fully constructed format.

Referring now to FIGS. 3 and 4, the top side 20 can now be formed. The locking flap 70 is folded 180° downwardly in the direction of arrow A relative to the front panel 38 such that the locking flap 70 generally bears against the interior surface 18 of the front panel 38. The first and second locking tabs 80, 82 are pushed through the opening 86. The first and second locking tabs 80, 82 then bear directly on the exterior surface 16 of the front panel 38 in general, and in particular, the first and second locking tabs 80, 82 bear directly on the third and fourth locking tabs 88, 90, respectively. Due to the resiliency of the blank 36, the first locking tab 80 is essentially spring loaded by the bend about the line of weakness 78, and it exerts a spring force onto the opposing third locking tab 88, such that the first and third locking tabs 80, 88 create a first pinch point 94 (FIG. 4). The second and fourth locking tabs 82, 90 operate in a similar manner to create a similar second pinch point 96. The line of weakness 78 of the locking flap 70 aids in the first and second locking tabs 80, 82 bending forward to extend through the opening 86. Furthermore, the line of weakness 78 is coincident with a top edge 98 of the opening 86 to ease the bending of the locking flap 70 and the disposing of the first and second locking tabs 80, 82 through the opening 86.

The left top tab 68 and the right top tab 72 are folded downwardly. The back flap 76 is folded forwardly 900 relative to the back top tab 74, and the back top tab 74 is folded 90° down onto the left and right top tabs 68, 72. The back flap 76 is inserted into the container 12 such that it bears against the locking flap 70 (seen best in FIG. 6). Due to the resiliency of the back flap 76 and the dimensioning of the container 12, the back flap 76 can exert a force on the locking flap 70, pushing it against the interior surface 18 of the front panel 38.

Referring now to FIG. 5, the strip 14 of FIG. 1 is disclosed in detail. The strip 14 includes the first end 32 and a second end 100 and a plurality of individual packets 34 connected in a series. The packets 34 of the strip 14 are each individually sealed from each other, and each include a frangible connection 102 to each adjacent packet 34. In this example the frangible connection 102 is a perforated connection 102. The strip 14 includes a plurality of filled packets 104 that each include a dosage of medicine 106 that a user is prescribed to ingest at a particular time. In this example, the dosage of medicine 106 is two pills, but other types and quantities of medicine could be used.

Each filled packet 104 further includes indicia 108 printed thereon. In the disclosed example, the indicia 108 is simply a day on which the user is to ingest the pills 106 held in the particular filled packet 104. However, the disclosed indicia 108 is merely for simplicity of the drawings, and one of skill will understand that the indicia 108 can provide many different types of information. For example, the indicia 108 can disclose the time and date to ingest the medicine 106, the names and strengths of the medicines disposed in the packet, the patient name, the prescribing doctor's name, and so forth.

Furthermore, the strip 14 may include at least one empty packet 110, i.e. an interstitial packet containing no pills. In this example, a first packet 112 of the strip 14 at the first end 32 is empty. However, the empty packet can be located anywhere in the strip 14 and can include text or graphics or both to warn a patient that the packets need to be refilled and/or that the packets will run out after a given number of days.

The strip 14 can be made from a long, narrow sheet of clear plastic. The sheet is folded over itself along its length to form a left edge 114. The sheet then is subjected to a series of horizontal heat seals 116 such that the horizontal heat seals 116 and the left edge 114 form three sides of each packet 34. The pills 106 can then be inserted into the respective packets 34, and the sheet is subjected to a vertical heat seal 118 to close each of the packets 34 and seal each set of pills 106 within each packet 34. Perforations 102 can then be added along the horizontal heat seals 116 such that each packet 34 can be torn from an adjacent packet 34. Although heat sealing is disclosed to form three sides of each individual packet 34, other forms of sealing can be used, such as sonic welding, adhesives, and the like.

The strip 14 further includes an indicator 120 at the second end 100 to inform the user that that the packets 34 bearing the indicator 120 are adjacent the second end 100, and thus that there are only a few remaining packets 34 in the container 12. In this example, the strip 14 includes an ending group 122 of packets 34 adjacent the second end 100. The ending group 122 of packets 34 can be the last remaining packets in the container, as in this example, but the ending group 122 can also be a set of packets 34 prior to the last remaining packets in the container. The indicator is 120 a stripe 124 extending over the ending group 122. Here, the ending group 122 includes a total of three packets 34. However, this is only one example, and the stripe 124 could extend over any number of packets 34 to provide more notice to the user that he or she needs to refill his or her prescription. As used in this disclosure, the term "adjacent the second end" means closer to the second end 100 than the first end 32. The term "adjacent the first end" means closer to the first end 32 than the second end 100. The indicator could alternatively be a different color plastic, different color markings, a dotted line, a geometric pattern or perforation, a countdown of numbers on the packets to the end of the strip (for example, 7, 6, 5, 4, 3, 2, 1), etc.

As shown in FIGS. 1 and 5, the first packet 112 of the strip 14 at the first end 32 is empty, i.e., it contains no medication, and it forms a grasping portion 126. The first packet 112 is connected to a second packet 128 that is a filled packet 104 and that is within the interior of the container 12. The second packet 128 is connected to a third packet 130 that is also filled. The first packet 112 is affixed to the exterior surface 16 of the container 12 with a piece of tape 132. In this manner, the assembly 10 can be manufactured and/or shipped with a portion of the strip 14 maintained outside of the container 12 and the filled packets 104 inside the container 12. The first packet 112 can be affixed to the exterior surface 16 in other ways, such as adhesive or simply a shrink wrapped plastic sheet tightly encompassing the assembly 10. Of course, the assembly 10 can be manufactured and/or shipped with the entire strip 14 disposed within the container 12.

Referring now to FIG. 6, to use the medicine dispensing assembly 10, a user grabs the grasping portion 126 and pulls the strip 14 until the second packet 128 is out of the container 12. Optimally, the user pulls the strip 14 until the perforated connection 102 between the second packet 128 and the first packet 112 is disposed under the first and second locking tabs 80, 82. The user can then pull upwardly on the strip 14, and the perforated connection 102 will tear against the first and second locking tabs 80,82. The user thereby tears the second packet 128 apart from the third packet 130, and then can tear open the second packet 128 and ingest the pills 106.

A front edge 134 of the third packet 130 is held in place between the first and third locking tabs 80, 88, and between the second and fourth locking tabs 82, 90 due to the force of the first and second locking tabs 80, 82 bearing on the third and fourth locking tabs 88, 90. Because of the first recess 84 and the second recess 92, the user may conveniently grasp the front edge 134 of the third packet 130 by grasping the third packet 130 in the area of the first recess 84 of the locking flap 70 and the second recess 92. The user can then pull out the third packet 130 as outlined above, and repeat for further packets 34.

After using the assembly 10 for several days or weeks, the user will notice that the selected packet 34 that he or she tears off includes the indicator 120. The user will then know that the selected packet 34 that he or she is grasping is adjacent the second end 100. In other words, when a user grabs a selected packet 34 bearing the indicator 120, he or she knows that they are running out of medication, and they need to either refill the prescription or contact their physician.

Figure 7:
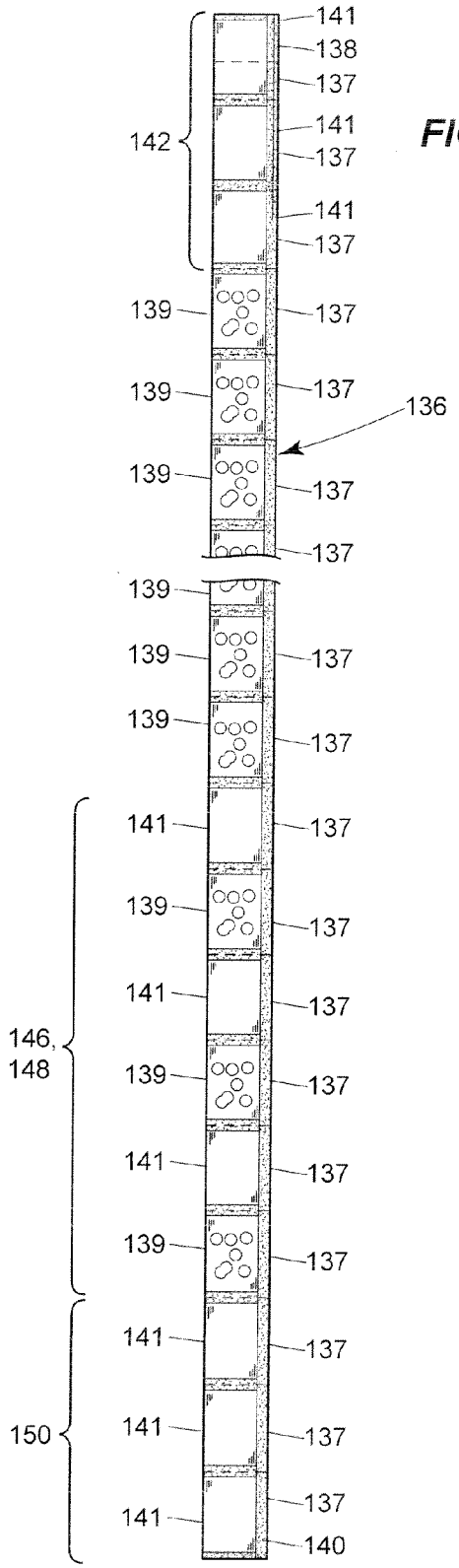
FIG. 7 is a plan view of a second example of a strip of medicine packets.

A second example of a strip 136 with a first end 138 and a second end 140 is shown in FIG. 7. Again, the strip 136 includes a series of packets 137 with both filled packets 139 and empty packets 141. In this example, the strip 136 includes a second example of a grasping portion 142. Here, the grasping portion 142 is three empty packets 141 at the first end 138. Three empty packets 141 may be easier to grasp when pulling the first end 138 of the strip 136 from the container 12. Accordingly, it may be decided that the grasping portion 126, 142 be one, two, three, or more empty packets 141 at the first end 138. In other examples of a grasping portion not shown, the grasping portion can be any structure that aids a user in grasping the first end the strip. For example, the grasping portion can be tab coupled to the first packet. Further, the grasping portion can be any of a string, a sheet, a loop, a clip or the like coupled to the first packet. If the first packet is a filled packet, then the first packet can be disposed within the container 12, and the grasping portion extends through the opening.

The strip of FIG. 7 also includes a second example of an ending group 146 and indicator 148. In this example, the ending group 146 includes a set of packets 137 adjacent the second end 140 where the packets 137 alternate between a filled packet 139 and an empty packet 141. The indicator 148 of this example is the ending group 146 forming the alternating set 146. Accordingly, a user will see the alternating set 146 of filled packets 139 and empty packets 141 and understand that his or her prescription needs to be refilled. While not required, the empty packets 141 could be printed with a warning indicator of some sort, such as, for example, "Reorder now—N days left." In other examples not shown, the indicator 148 could be a number printed on a packet 137 indicating how many days until the prescription runs out, or a written warning to refill the prescription. Further, the indicator 148 could be that the indicia 108 is printed in a different color in the ending group. In other words, for the majority of the strip, the indicia 108 on the packets 137 are printed in an first color, such as green, but the indicia 108 on the packets 137 in the ending group 146 is printed in a second color, such as red, or even combinations of colors.

The strip of FIG. 7 further includes a boosting group 150 of packets 137. The boosting group includes a total of three empty packets 141 at the second end 140 of the strip 136. As will be understood, the second end 140 of the strip 136 is disposed at the bottom side 22 of the container 12. By including a boosting group 150 at the second end 140, the filled packets 139 are boosted upwardly away from the bottom side 22 of the container 12. This can make it easier to pull the filled packets 141 through the opening 86.

Further, the container 12 may be constructed of different colors. In some households, multiple people use prescription medications. Thus, a first container can be a first color such as blue, and a second container can be a second color such as red or any other color that is different than the first color.

Numerous additional modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed:

1. A dispensing assembly for dispensing a medication, the dispensing assembly comprising:

a container with an opening;

a strip of serially connected packets, the strip having a first end and a second end, a portion of the strip disposed in the container, the strip containing at least one prescription of individual dosages of medicine, wherein the first end extends through the opening and out of the container, and the second end is disposed in the container and below the opening, such that the second end of the strip is not visible from outside the container;

the strip including a plurality of filled packets, each of the plurality of filled packets including at least one of the individual dosages of the medicine;

the strip including an ending group, the ending group being closer to the second end of the strip than to the first end of the strip, the ending group comprising a subset of the plurality of filled packets, the subset of the plurality of filled packets comprising at least two of the plurality of filled packets; and an indicator associated with the ending group of the strip, wherein the indicator indicates that the at least one prescription contained in the strip needs to be refilled, and wherein the indicator comprises an alternating set of packets, wherein the ending group further comprises an empty packet with no dosages of the medicine, the empty packet being positioned next to a first one of the subset of the plurality of filled packets and closer to the second end of the strip than the first one of the subset of the plurality of filled packets, wherein the alternating set of packets comprises the first one of the subset of the plurality of filled packets, the empty packet, and a second one of the subset of the plurality of filled packets, the second one of the subset of the plurality of filled packets being positioned next to the empty packet and closer to the second end of the strip than the empty packet.

2. The dispensing assembly of claim 1, wherein the strip includes an empty set of packets at the second end with no dosages of the medicine, wherein the empty set of packets raises the plurality of filled packets toward the opening.

3. The dispensing assembly of claim 1, wherein a warning message is printed on the empty packet of the alternating set of packets, and wherein the warning message further indicates that the at least one prescription contained in the strip needs to be refilled.

4. The dispensing assembly of claim 3, wherein the warning message indicates a number of days until the at least one prescription contained in the strip will run out.

* * * * *